United States Patent [19]

Asano et al.

[11] 4,122,635

[45] Oct. 31, 1978

[54] GRINDING MACHINE WITH A TRUING DEVICE

[75] Inventors: Hiroaki Asano, Chiryu; Toshio Tsujiuchi, Anjoh, both of Japan

[73] Assignee: Toyoda Koki Kabushiki Kaisha, Kariya, Japan

[21] Appl. No.: 841,106

[22] Filed: Oct. 11, 1977

[51] Int. Cl.[2] ..... B24B 49/18

[52] U.S. Cl. ..... 51/165.71; 51/165.87

[58] Field of Search ..... 51/165.87, 165.88, 165.71, 51/165.77

[56] References Cited

U.S. PATENT DOCUMENTS

| | | | |
|---|---|---|---|
| 3,079,709 | 3/1963 | Price | 125/11 TP |
| 3,885,353 | 5/1975 | Ota et al. | 51/165.87 |
| 3,971,168 | 7/1976 | Nishimura et al. | 51/165.87 |

*Primary Examiner*—Harold D. Whitehead

*Attorney, Agent, or Firm*—Oblon, Fisher, Spivak, McClelland & Maier

[57] ABSTRACT

A grinding machine, having a wheel carrier with a rotatable cubic boron nitride grinding wheel mounted on a bed. The wheel carrier is slidable with respect to a work support device and a truing device, which are selectively opposed to the grinding wheel through movement of a traverse table. Feed and feed control devices are provided to feed the wheel carrier from a transient original position to an advanced position in a grinding operation. A detecting device is further provided to detect an absolute original position of the wheel carrier. The feed control device is arranged such that, whenever a truing instruction is supplied, the wheel carrier is retracted to the absoluted original position and then, is advanced therefrom to a truing position incremented by a predetermined truing infeed amount from the advanced position.

9 Claims, 7 Drawing Figures

GRINDING MACHINE WITH A TRUING DEVICE

BACKGROUND OF THE INVENTION

1. Field of the Invention

This invention relates generally to a grinding machine, and more particularly to a grinding machine with a truing device for truning a grinding wheel made of hard abrasive grain such as, for example, cubic boron nitride (CBN), diamond or the like.

2. Description of the Prior Art

In a known grinding machine incorporating a digital feed controller, there are provided digital switches for setting control data such as, for example, feed amount, feed rate, dwell time and the like, and the feed movement of a wheel carrier is controlled by a stepping motor in accordance with the control data. The wheel carrier is moved between a transient original position and an advanced position in a grinding operation, and the transient original position is compensated for a reduction in radius of a grinding wheel each time the same is trued. The memory of the transient original position is lost at the occurrence of an interruption of electric supply or an emergency stop. In order to return the wheel carrier to the transient original position, an absolute original position is provided, and when a re-starting is made after the interruption of electric supply or the emergency stop, the wheel carrier is once retracted to the absolute original position and then, is again returned to the transient original position by being advanced by a distance between the absolute and transient original positions which distance is memorized in a fixed memory device such as, for example, a core memory unit or a latch relay circuit.

CBN grinding wheels are being increasingly applied to grinding machines of the above-noted type wherein an importance is placed not only upon machining efficiency but also upon machining accuracy, though for many past applications of the CBN grinding wheels emphasis has been placed only upon machining efficiency, as in cutting operation. In an application of the CBN grinding wheel to such a digital control grinding machine, however, it is desirable to arrange a truing device for the CBN grinding wheel upon the work table or the machine bed since the CBN grinding wheels have a long tool life and do not require truing operations as frequently as do other less durable grinding wheels. Furthermore, in truing the CBN wheel, it is important to precisely infeed the CBN grinding wheel since CBN grinding wheels are quite expensive.

SUMMARY OF THE INVENTION

Accordingly, it is a primary object of the present invention to provide an improved grinding machine capable of effecting a precise truing infeed between a grinding wheel on a wheel carrier and a truing device on a bed or a work table.

Another object of the present invention is to provide an improved digital control grinding machine wherein a feed error in a grinding feed cycle of the operation does not affect the truing infeed movement of a grinding wheel against a truing device mounted on a work table.

Another object of the present invention is to provide an improved digital control grinding machine of the character set forth above wherein, whenever a truing is instructed, a wheel carrier is returned to an absolute original position before being advanced to a truing position.

A further object of the present invention is to provide an improved digital control grinding machine of the character set forth above which is capable of truing a CBN grinding wheel with a high degree of precision.

A still further object of the present invention is to provide an improved digital control grinding machine of the character set forth above wherein an absolute original position for a wheel carrier is maintained indisplaceable without being influenced by thermal deformation of machine parts.

Briefly, according to the present invention, there is provided a grinding machine which comprises a bed; a wheel head slidably mounted upon the bed and adapted to rotatably carry a grinding wheel; a work support for rotatably supporting a workpiece; a truing device for truing the grinding wheel; a feed device for feeding the wheel head toward and away from the truing means; a detector for detecting an absolute original position of the wheel head; a distance designator for designating a distance, necessary for the wheel head to move from the absolute original position toward the truing device so as to infeed the grinding wheel against the truing device by a predetermined truing infeed amount; and a feed controller responsive to a truing instruction for controlling the feed device to feed the wheel head to the absolute original position and then, to feed the wheel head by the distance from the absolute original position toward the truing device as designated by the distance designator. Accordingly, the truing feed of the wheel head toward the truing device is started from the absolute original position at any time, such that the grinding wheel is precisely infed by the predetermined truing infeed amount against the truing device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF A PREFERRED EMBODIMENT

Figure 1:
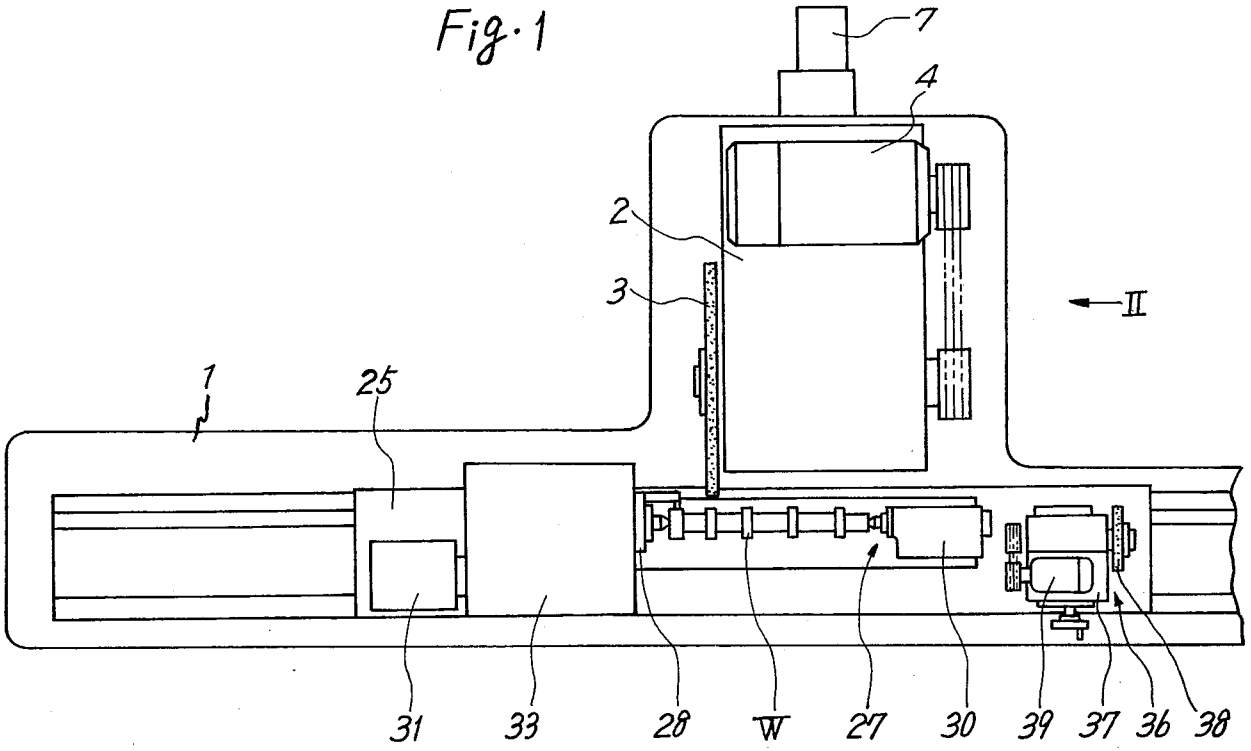
FIG. 1 is a plan view of a grinding machine according to the present invention.
Figure 2:
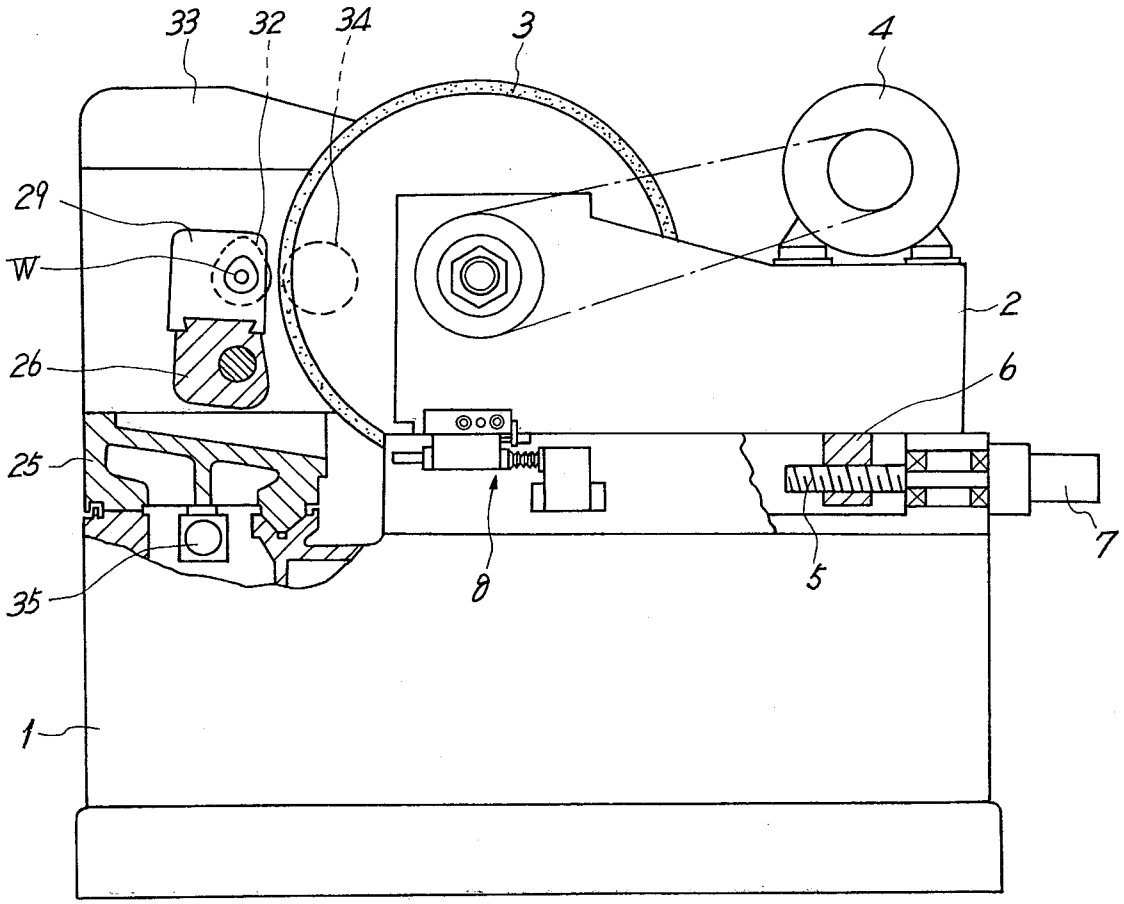
FIG. 2 is a side view, partly in section, of the apparatus as viewed from a direction of the arrow II in FIG. 1.

Referring now to the drawings, wherein like reference numerals designate like or corresponding parts throughout the several views, and particularly to FIG. 1 thereof, a cam grinding machine is shown comprising a bed 1, on which a wheel head 2 is mounted to be slidable toward and away from a workpiece W. A grinding wheel 3, configured with abrasive grains of hard material such as cubic boron nitride bonded on the circumferential surface of a metallic disc in a stratum form, is rotatably supported on the wheel head 2. The grinding wheel 3 is drivingly connected via pulleys and belts to a wheel drive motor 4 mounted on the wheel head 2. Within the bed 1, as shown in FIG. 2, a feed screw 5 is rotatably carried, with which a feed nut 6 secured to the wheel head 2 is threadedly engaged. A servomotor 7 is connected to the feed screw 5 so as to rotate feed screw 5 and thereby move the wheel head 2 toward and away from the workpiece W.

Figure 3:
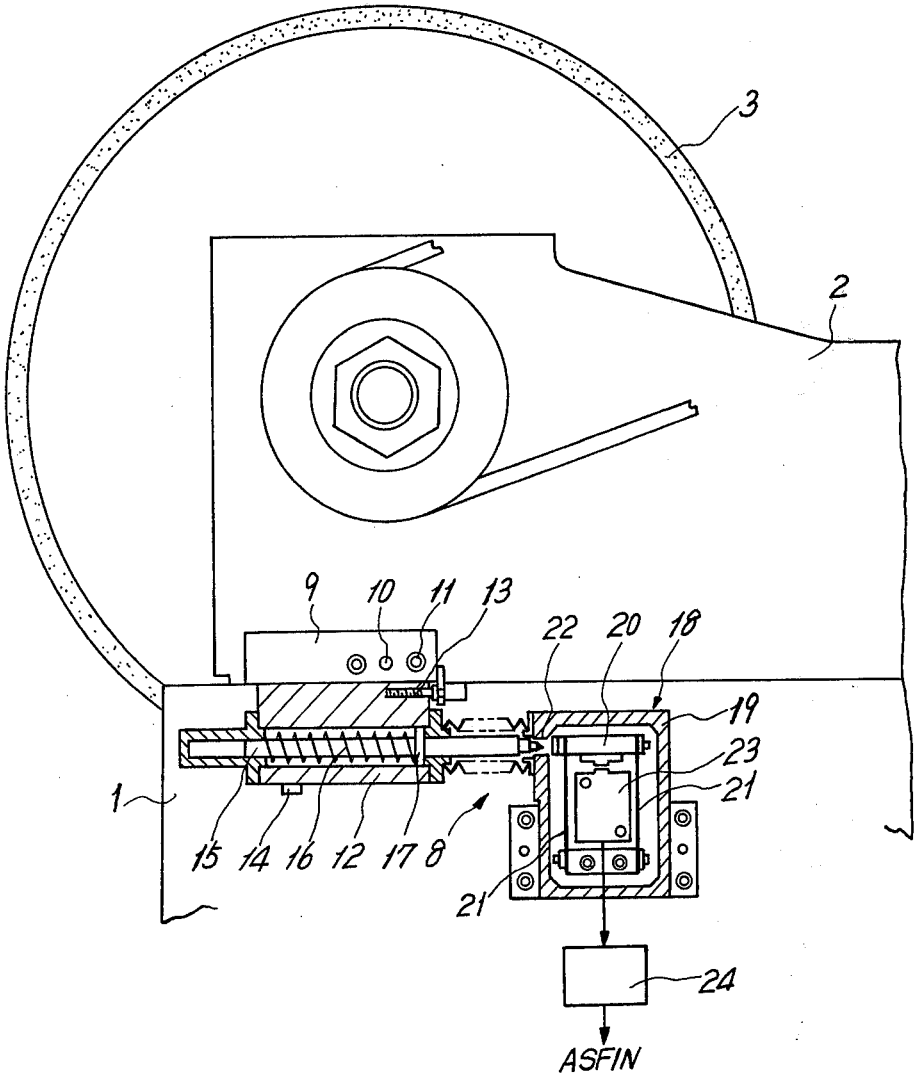
FIG. 3 is an enlarged sectional view of the original position detecting device shown in FIG. 2.

An original position detector 8, for generating a positioning signal ASFIN when the wheel head 2 reaches an absolute original position, is disposed immediately under the rotational axis of the grinding wheel 3. Specifically, on the side surface of the wheel head 2 extending under the rotational axis of the grinding wheel 2, an attaching member 9 is fixed by means of bolts 11, being positioned by a locating pin 10, as best shown in FIG. 3. A dog support 12 is guided on the attaching member 9 in parallel relation with the sliding movement of the wheel head 2 and is threadedly engaged with an adjusting screw 13 rotatably carried by the attaching member 9. The dog support 12 is secured by means of a tightening bolt 14 on the attaching member 9 after being adjustably positioned by rotating the adjusting screw 13. For movement in parallel relation with the wheel head 2, a dog bar 15 is slidably received in the dog support 12 and has its rear end protruding in a rearward direction of the wheel head 2. A compression spring 16 is provided to urge the dog bar 15 to move in the rearward direction of the wheel head 2, and the dog bar 15 is held with its reference flange 17 in abutting engagement with a reference face of the dog support 12.

Fixedly mounted on the bed 1 is a sensing device 18, which is actuated when the wheel head 2 reaches the absolute original position and then issues the positioning signal ASFIN. The details of the sensing device 18 is now described. On the frame member 19 fixed upon the bed 1, a magnet having positive and negative poles is supported by means of parallel leaf springs 21 so as to be movable in the same direction as the wheel head 2 is moved. The magnet 20 is displaced when pressed by the rear end of the dog bar 15 which is retracted through an opening 22, formed on the frame member 19, together with the wheel head 2. The rear end of the dog bar 15 is formed with a step-up portion which is in abuttable relation with the peripheral portion of the opening 22, so that, even when the wheel head 2 is excessively retracted, the dog bar 15 is stopped. The compression spring 16 is compressed so as to prevent the excessive displacement of the magnet 20. A detecting head 23 is fixed within the frame member 19 in face-to-face relation with the magnet 20. Detecting head 23 outputs a waveform proportional to the displacement of the magnet 20. A zero-detecting circuit 24 is connected to the detecting head 23 and generates the positioning signal ASFIN when retraction of the wheel head 2 to the absolute original position makes the output from the detecting head 23 zero.

Slidably mounted on the bed 1 is a traverse table 25, which is connected to a feed cylinder device 35 for movement in a transverse direction relative to the wheel head 2. A rocking table 26 is pivotably supported on the traverse table 25. For providing a workpiece support device 27, a work head 29 rotatably carrying a work spindle 28 is mounted on the rocking table 26, on which a foot stock 30 is also mounted confronting the work head 29. The work spindle 28 is provided at its one end with a center, not numbered, to support a workpiece W in cooperation with a footstock center, not numbered, and is in driving connection with a work drive motor 31 to rotate the workpiece W. In order to effect the rocking movement of the rocking table 26 during grinding operations for cams of the workpiece W, master cams 32 are keyed upon the work spindle 28, and a follower roller 43 is freely rotatably carried within the headstock housing 33 fixedly disposed on the traverse table 25. It is noted that the follower roller 34 is brought into radial alignment with one of the master cams 32 in a well-known manner when one of the cams on the workpiece W associated with one of the master cams 32 is brought into radial alignment with the grinding wheel 3. Within the headstock housing 33, there is further arranged tension springs, not shown, by which the rocking table 26 is urged to pivot in a clockwise direction, as viewed in FIG. 2, so that the selected one of the master cams 32 comes into contact with the follower roller 34.

Indicated at 36 in FIG. 1 is a truing device for truing the grinding wheel 3, and a truing carrier 37 of the device 36 is slidably mounted on one end of the traverse table 25 so as to be adjustable in a direction parallel with the movement of the wheel head 2. A truing wheel 38 is located on the truing carrier 37 and is composed of a metallic disc, at the outer periphery of which diamond particles are bonded in a stratum form. The truing wheel 38 on the truing carrier 37 is mounted rotatably about an axis parallel with the rotational axis of the grinding wheel 3. A truer drive motor 39, mounted on the truing carrier 37, is drivingly connected to the truing wheel 38 so as to rotate the same in such a direction as to reduce the peripheral speed relative to the grinding wheel 3.

Figure 4:
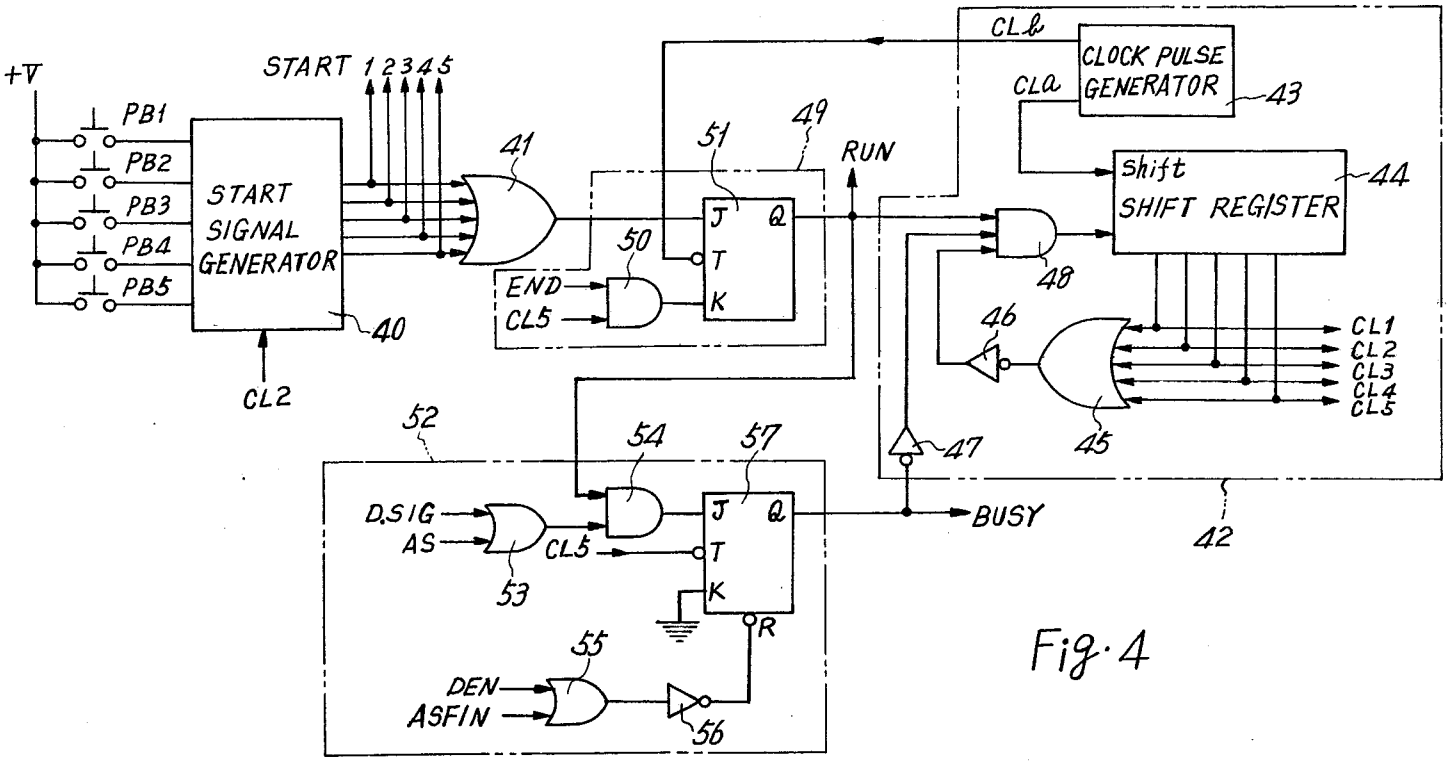
FIGS. 4, 5 and 6 are block diagrams illustrative of a programmable digital feed controller for controlling feed cycles of the apparatus.

A programmable controller for controlling various feed cycles of the wheel head 2 is hereinafter described. In FIG. 4, connected to a signal generator 40 are push button switches PB1–PB5, which initiate the various feed cycles. These feed cycles include a returning cycle to the absolute original position, an initial transient original position setting cycle, a grinding cycle, a grinding wheel truing cycle and a returning cycle to a transient original position, respectively. The signal generator 40 generates any one of the start signals START1–START5 when one of the push button switches PB1–PB5 is depressed and when other conditions for a start of a feed cycle corresponding to such one switch are all satisfied. The signal generator 40 continues generating any one of the start signals START1–START5 until it receives a second timing pulse CL2, which is discussed hereinafter.

Generally indicated at 42 is a timing pulse generating circuit, which generates timing pulses CL1–CL5 during a control data read-out cycle, and which prevents the generation of such timing pulses CL1–CL5 during the execution of feed movement. The generating circuit 42 comprises a clock pulse generator 43 for generating a first train of clock pulses CL*a* and a second train of clock pulses CL*b* which are delayed a quarter cycle relative to the clock pulses CL*a*, and a shift register 44 which receives at its input terminal the clock pulses CL*a* from the pulse generator 43 and at a serial input terminal an input from an AND gate 48. Output terminals of the shift register 44 are connected to an OR gate 45, whose output terminal is in turn connected to the AND gate through an inverter 46. Other input terminals of the AND gate 48 are connected, respectively, to a run-flag circuit 49 and, via an inverter 47, to a busy-flag circuit 52. Accordingly, the shift register 44 generates the first timing pulse CL1 when initially receiving an input from the AND gate 48 as well as one clock pulse from the clock pulse generator 43 and, subsequently, generates the second to fifth timing pulses CL2–CL5 in response to the successive clock pulses from the pulse generator 43.

The run-flag circuit 49 is provided for generating a RUN signal during each feed cycle and comprises an AND gate 50 and a J–K flip-flop 51. The AND gate 50 is connected to an instruction decoder 64, hereinafter described, to receive a signal END therefrom and to the shift register 44 to receive the fifth timing pulse CL5 therefrom. The J–K flip-flop 51 is connected at its J terminal with an Or gate 41, to which the above-noted start signals START1–START5 are input, and at its T terminal with the clock pulse generator 43 to receive the clock pulses CL*b* therefrom. The flip-flop 51 is further connected at its K terminal with the AND gate 50 and, when set, outputs the RUN signal from its Q terminal to the AND gate 48.

The busy flag circuit 52 is provided for generating a BUSY signal during the execution of feed operation and primarily comprises a J–K flip-flop 57. This flip-flop 57 is connected at its J terminal with an AND gate 54, at its T terminal with the output terminal for the fifth timing pulse CL5 of the shift register 44, and at its reset terminal R with an inverter 56 and, when set, outputs the BUSY signal from its Q terminal to the above-noted inverter 47. Input terminals of the AND gate 54 are connected, respectively, with the Q terminal of the J–K flip-flop 51 and with an OR gate 53, which is connected at its input terminals with an instruction decoder 64 so as to receive signals D.SIG and AS therefrom. The inverter 56 is connected at its input terminal with an OR gate 55, whose input terminals are connected to respectively receive a signal DEN from a subtraction counter 98, hereinafter described, and the signal ASFIN from the zero-detecting circuit 24 of the original position detector 8.

Figure 5:
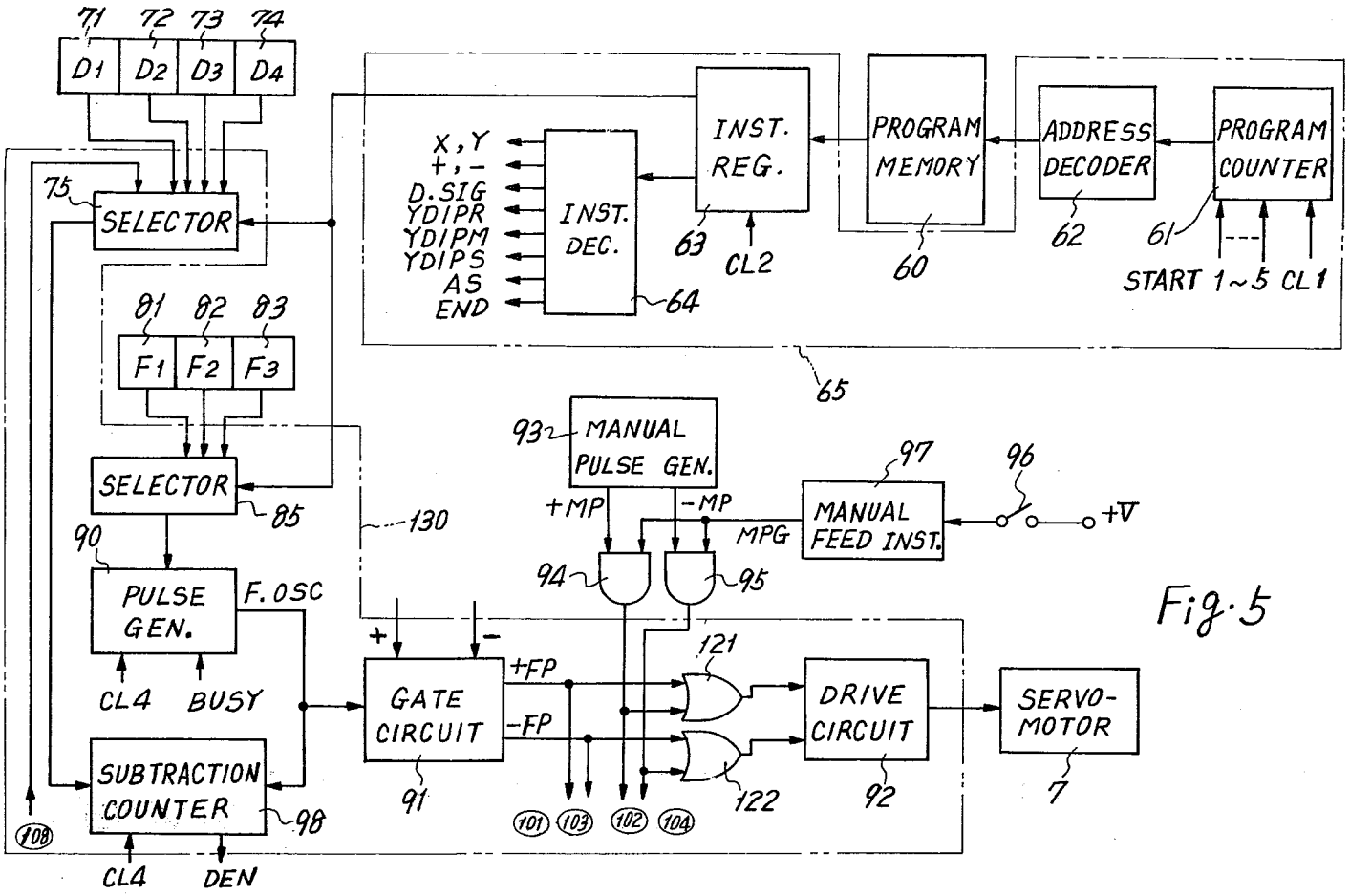

Referring to FIG. 5, a program memory 60 is shown, which has control programs at its memory addresses *m*10–*m*51, as shown in the following tables 1 to 5, for controlling the feed movement of the wheel head 2 in the returning cycle to the absolute original position, the initial transient original position setting cycle, the grinding cycle, the wheel truing cycle, and the returning cycle to a transient original position.

TABLE 1

| | |
|---|---|
| m10 | X − F3AS |
| m11 | YD1PR |
| m12 | END |

TABLE 2

| | |
|---|---|
| m20 | X − D3F3 |
| m21 | YD1PM |
| m22 | END |

TABLE 3

| | |
|---|---|
| m30 | X + D1F1 |
| m31 | X + D2F2 |
| m32 | X − D3F3 |
| m33 | END |

TABLE 4

| | |
|---|---|
| m40 | X + F3AS |
| m41 | X + D5F3 |
| m42 | X + D3F3 |
| m43 | YD1PS |
| m44 | X + D4F3 |
| m45 | YD1PM |

TABLE 4-continued

| | |
|---|---|
| m46 | END |

TABLE 5

| | |
|---|---|
| m50 | X + D5F3 |
| m51 | END |

Connected with the signal generator 40 and the shift register 44 is a program counter 61 of data read-out means generally indicated at 65, and the counter 61 is provided for designating memory addresses at which the above-noted control program or data is stored. This counter 61 is set to a memory address *m*10, *m*20, *m*30, *m*40 or *m*50 upon receiving a first timing pulse CL1 and a start signal START1, START2, . . . or START5. The counter 61 in the absence of any of the start signals START1–START5 is advanced by one each time when receiving the first timing pulse CL1. An address decoder 62 is connected between the program counter 61 and the memory 60 and decodes the content of the program counter 61 so as to select the memory address of the program memory 60 designated by the program counter 61. An instruction register 63 is connected to the program memory 60 to temporarily memorize and read out one block of the control data being memorized at the selected memory address of the program memory 60. This register 63 outputs feed amount data D1–D5 and feed rate data F1–F3 of the control data, respectively, to first and second selectors 75 and 85, and also outputs other data X, Y, +, −, YD1PR, YD1PM, YD1PS, As and END to an instruction decoder 63. The instruction decoder 64, in addition to decoding the read-out block of the control data, generates a signal D.SIG when any one of the feed amount data D1–D5 is included in the read-out block of the control data.

Digital switches 71–74 with their numbers D1–D4 are provided in which feed amounts are preset to be selected by the first selector 75. This selector 75, constituting a part of drive control means generally indicated at 130, selectively connects the digital switches 71–74 to a presettable subtraction counter 98 upon receipt of any one of the feed amount data D1–D4 and connects an output of a memory circuit 108 shown in FIG. 6 to the subtraction counter 98 upon receipt of the feed amount data D5. In order to preset various feed rates, there if provided another group of digital switches 81–83 with the respective numbers F1–F3 which the second selector 85 selectively connects with a feed pulse generator 90 upon receipt of any one of the feed rate data F1–F3. It is apparent that the feed amount data D1–D4 correspond, respectively, to the first mentioned digital switches 71–74 and the memory circuit 108 and that the feed rate data F1–F3 correspond, respectively, to the last mentioned digital switches 81–83.

The feed pulse generator 90 is connected to the shift register 44 to respond to the fourth timing pulse CL4 and to thereby receive as frequency setting data one of the feed rate data F1–F3 from the selector 85. The pulse generator 90, while receiving the BUSY signal from the flip-flop 57, generates feed pulses F·OSC at a frequency corresponding to the selected feed rate data and connects the feed pulses F·OSC to the subtraction counter 98 and to a gate circuit 91. The gate circuit 91, also connected to the instruction decoder 64, distributes the feed pulses F·OSC as advance feed pulses +FP to a positive input terminal of a drive circuit 92 via an OR gate 121 when receiving the signal "+" and as retraction feed pulses −FP to a negative input terminal thereof via an OR gate 122 when receiving the signal "−", so that the servomotor 7 can be rotated selectively in both directions.

A manually operated pulse generator 93 is provided with a handle, not shown, which effects the generation of advance feed pulses +MP when rotated in one direction and the generation of retraction feed pulses −MP when rotated in the other direction. Output terminals of the pulse generator 93 are connected with AND gates 94 and 95, which are in turn connected at their output terminals with the OR gate 121 and 122, respectively. The other input terminals of the AND gates 94, 95 are connected to a manual feed instruction circuit 97, which generates a signal MPG while a switch 96 for instructing manual feed is closed. The subtraction counter 98, when receiving the fourth timing pulse CL4 from the shift register 44, is preset with one of the set values of the digital switches 71–74 or a memorized value of the memory circuit 108 shown in FIG. 6. This counter 98 receives the feed pulses F·OSC to subtract the same from the preset value and outputs a signal DEN to the OR gate 55 when its content becomes "0".

Figure 6:
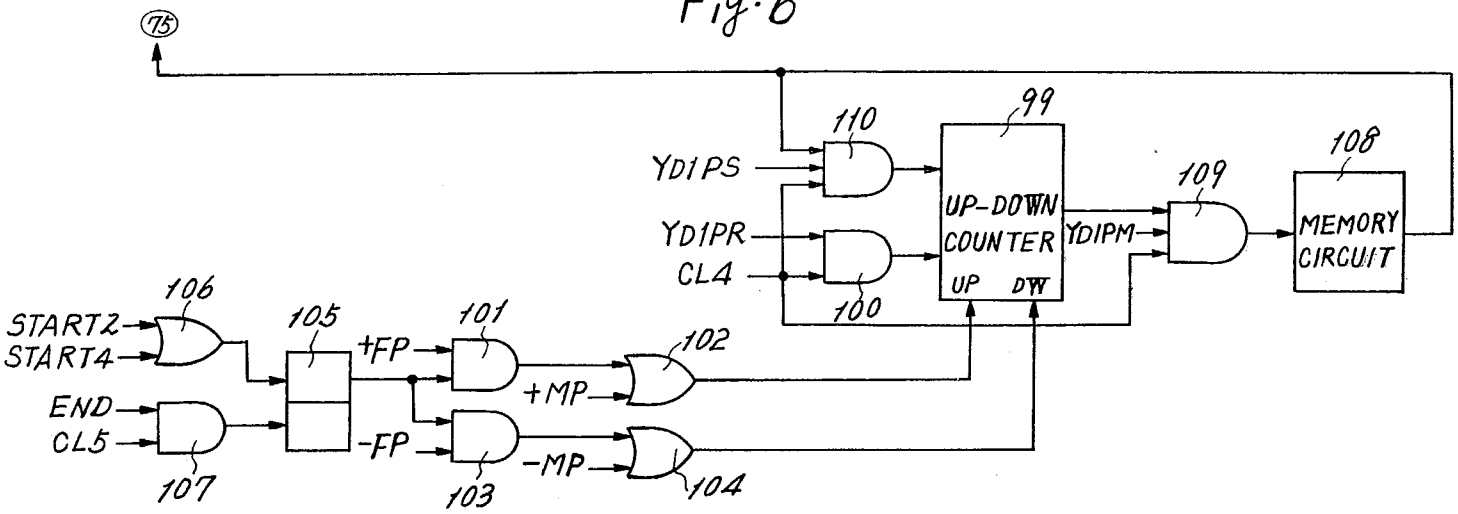

As shown in FIG. 6, an up-down counter 99 is provided for counting a feed distance between the absolute and transient original positions in the initial transient original position setting cycle and the wheel truing cycle. A reset terminal of the counter 99 is connected with the output of AND gate 100, whose input terminals are respectively connected to the decoder 64 and the shift register 44 so as to receive the signal YD1PR and the fourth timing pulse CL4. The count-up terminal UP of the counter 99 is connected to an OR gate 102, which receives the advance feed pulses +MP from the manually operated pulse generator 93 and an output from an AND gate 101. The counter 99 is further connected at count-down input terminal DW to an OR gate 104, which receives the retraction feed pulses −MP from the pulse generator 93 and an output from an AND gate 103. The AND gates 101, 103 are connected to the +FP and −FP output signals of the gate circuit 91, respectively, and at the other input terminals thereof to an output terminal of a flip-flop 105. An OR gate 106 is connected to the signal generator 40 to transmit the start signals START2 and START4 to a set input terminal of the flip-flop 105. An AND gate 107 is connected to the decoder 64 and the shift register 44 and, when receiving the signal END and the fifth timing signal CL5, operates to reset the flip-flop 105.

The memory circuit 108, constituting together with the digital switches 71–74 distance designation means, is provided for memorizing the feed distance between the absolute and transient original positions. The memory circuit 108 is composed of, for example, latch relays or core memories lest it should lose its memory content at the time of an interruption of electric supply or an emergency stop. This circuit 108 is connected to the up-down counter 99 through an AND gate 109 so as to memorize the content of the up-down counter 99. The AND gate 109 is connected at its other two input terminals to the decoder 64 and the shift register 44 so as to connect the content of the counter 99 to the memory circuit 108 when receiving the signal YD1PM and the fourth timing pulse CL4. An AND gate 110 is connected at its input terminals to the memory circuit 108, the decoder 64 and the shift register 44 and, when receiving the signal YD1PS and the fourth timing pulse CL4, presets the content being memorized in the memory circuit 108 to the up-down counter 99.

The operation of the apparatus as constructed above is now described.

Returning Cycle to Absolute Original Position

Figure 7:
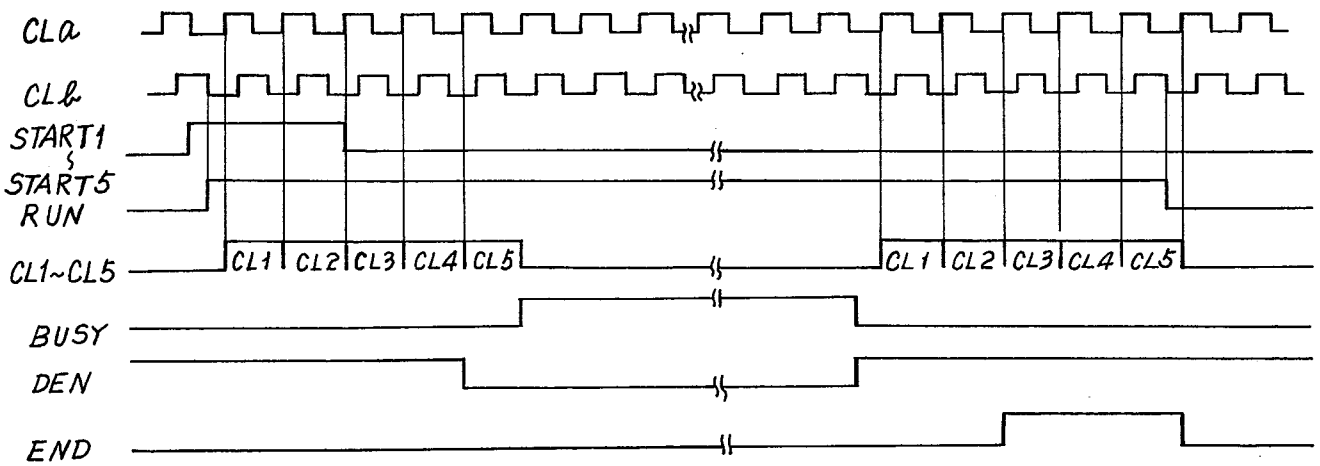
FIG. 7 is a time chart illustrative of control signals in the feed controller.

When the push button switch PB1 is depressed, the start signal START1, as shown in FIG. 7, is generated to initiate the returning cycle to the absolute original position. In response to the start signal START1, the J–K flip-flop 51 of the run flag circuit 49 is set, from which the RUN signal is output. Since, initially no BUSY signal is being output from the J–K flip-flop 57 of the busy flag circuit 52, the shift register 44 of the timing pulse generating circuit 42 outputs the timing pulses CL1–CL5 for one cycle upon receipt of the RUN signal through the AND gate 48. One block of the control data is read-out during the outputting of the timing pulses CL1–CL5.

Having received the start signal START1, the program counter 61 is set to an address number *m*10 when receiving the first timing pulse CL1. Upon receipt of the second timing pulse CL2, the signal generator 40 stops outputting the start signal START1, and the instruction register 63 reads out one block X−F3AS of the control date being memorized at the address number *m*10 of the memory 60. Thus, the digital switch 83 is selected and the signals X, "−" and AS are output from the decoder 64. A rapid feed rate F3 being set in the digital switch 83 is loaded as preset data to the feed pulse generator 90 when the same receives the fourth timing pulse CL4.

Feed movement is executed after the outputting of the timing pulses CL1–CL5. Namely, since the RUN signal and the signal AS are still being maintained as outputs, the flip-flop 57 of the busy-flag circuit 52 is set upon receipt of the fifth and last timing pulse CL5 and then outputs the BUSY signal. The feed pulse generator 90 outputs the feed pulses F·OSC at a frequency corresponding to the rapid feed rate, as soon as it receives the BUSY signal. Since the signal "−" has been applied to the gate circuit 91, the feed pulses F·OSC are supplied as retraction feed pulses—FP to the drive circuit 92 so as to reversely rotate the servomotor 7, so that the wheel head 2 is retracted at the rapid feed rate.

When the wheel head 2 reaches the absolute original position, the original position detector 8 is operated to output the positioning signal ASFIN, in response to which the J–K flip-flop 57 is reset to stop the output of the BUSY signal. At this time, the feed pulse generator 90 immediately halts the output of feed pulses F·OSC. In this manner, the wheel head 2 is retracted at the rapid feed rate and is positioned at the absolute original position. Furthermore, disappearance of the BUSY signal causes a signal "1" to appear at the serial terminal of the shift register 44, which then outputs the timing pulses CL1–CL5 for the next one cycle. Since no start signal START1 is present in this stage, the program counter 61 is advanced by one upon receipt of the first timing pulse CL1 and consequently, one block YD1PR of the control data being memorized at a memory address *m*11, as shown in TABLE 1, is read out to the instruction register 63. The decoder 64 outputs the signal YD1PR to the AND gate 100, which resets the up-down counter 99 when receiving the fourth timing pulse CL4. Finally, when one block END of the control data being memorized at a memory address *m*12, as shown in TABLE 1, is read out, the signal END is sent out from the decoder 64 to the AND gate 50 of the run-flag circuit 49 and the flip-flop 51 is reset, so that the execution of the returning cycle to the absolute original position is completed.

Transient Original Position Setting Cycle

Following the returning cycle to the absolute original position, this cycle is executed in order to decide the transient original position of the wheel head 2. In this cycle, the wheel head 2 is advanced to an advanced position in a grinding operation and then is retracted by the total grinding feed amount. Namely, the manual feed instruction switch 96 is closed to cause the instruction circuit 97 to output the signal MPG, and the handle of the pulse generator 93 is rotated in one direction thereby advancing the wheel head 2 to the advanced position. With the wheel head 2 in the advanced position, the grinding wheel 3 slightly comes into contact with a sizing master, not shown, which is set upon the workpiece support device 27. During this time, the advance feed pulses +MP from the pulse generator 93 are supplied through the OR gate 102 to the Up-terminal of the up-down counter 99, which then counts a distance between the absolute original position and the advanced position. Following this, the start push button switch PB2 is depressed to generate the start signal START2 from the start signal generator 40. Thereafter the initial original position setting cycle is, thus, automatically initiated in the following manner.

The flip-flop 51 outputs the RUN signal since it is set in response to the start signal START2, and the program counter 61 is set to an address number *m*20 upon receipt of the first timing pulse CL1. One block X−D3F3 of the control data being memorized at the memory address *m*20 of the memory 63, as shown in TABLE2, is read out to the instruction register 63 when the register 63 receives the second timing pulse CL2. The digital switch 73 is selected, whose set value (a total grinding feed amount) presets the subtraction counter 98 when the same receives the fourth timing pulse CL4. Simultaneously, the rapid feed rate set in the digital switch 83 is loaded to the feed pulse generator 90.

Since the RUN signal and the signal D SIG have been output, respectively, from the RUN flag circuit 49 and the decoder 64, the flip-flop 57 is set in response to the fifth timing pulse CL5 to output the BUSY signal, and the feed pulses F·OSC are generated from the feed pulse generator 90. These feed pulses F·OSC are supplied as retraction feed pulses −FP to the drive circuit 92 through the gate circuit 91 receiving the signal "−", whereby the wheel head 2 is retracted by the servomotor 7 reversely rotating at the rapid feed rate. The subtraction counter 98 receives the feed pulses F·OSC to subtract the same from the preset value therein and generates the signal DEN when its content is reduced to "0". This signal DEN causes the busy flag circuit to be reset and to discontinue the output of feed pulses F·OSC. In this manner, the wheel head 2 is retracted by the set value of the digital switch 73 at the rapid feed rate and is positioned at the transient original position. During this time, the retraction feed pulses −FP are supplied also to the down terminal of the up-down counter 99 through the AND gate 103 and the OR gate 104 since the flip-flop 105 has been set from the time it received the start signal START2 through the OR gate 106. It is therefore noted that the distance between the absolute original position and the transient original position is left as data in the up-down counter 99.

The disappearance of the BUSY signal allows the AND gate 48 to input "1" to the serial terminal of the shift register 44, which then generates the timing pulses CL1–CL5 for the subsequent one cycle. Since the program counter 61, when receiving the first timing pulse CL1, is advanced by one, one block YD1PM of the control data being memorized at an address *m*21, as shown in TABLE 2, is then read out to the register 63. As a result, the signal YD1PM is applied as an output from the decoder 64 to the AND gate 109. Another input of AND gate 109 is the content of the up-down counter 99. The output of AND gate 109 is applied as an input to the memory circuit 108 and is memorized therein when the fourth timing pulse CL4 is output. At the next cycle, one block END of the control data being memorized at an address *m*22 is read out, thus resulting in resetting the run-flag circuit 49, whereby the execution of the initial transient original position setting cycle is completed.

Grinding Cycle

Upon completion of the transient original position setting cycle, a workpiece W with unfinished cams is loaded on the workpiece support device 27. The rocking table 26 is pivotably moved on the traces of one of the master cams 32 which is in contact with the follower roller 34. In order to grind one of the unfinished cams to an intended profile, the grinding cycle of the wheel head 2 is executed in the following manner.

The start push button switch PB3 is depressed and inputs the start signal START3 to the run-flag circuit 49, which then outputs the RUN signal. Based upon the start signal START3, the program counter 61 is set to an address number *m*30, and the register 63, when receiving the second timing pulse CL2, reads out one block X+D1F1 of the control data being memorized at an address *m*30, as shown in TABLE 3. The wheel head 2 is advanced by a coarse grinding feed amount set in the digital switch 71 and at a coarse grinding feed rate set in the digital switch 81, so that a first cam of the workpiece W is coarsely ground by the grinding wheel 3 in accordance with one of the master cams 32.

When the second timing pulse CL2 is generated from the shift register 44 in the following one cycle, there is read out one block of the control data X+D2F2. The wheel head 2 is advanced by a fine grinding feed amount set in the digital switch 72 at a fine grinding feed rate set in the digital switch 82, whereby the first cam of the workpiece W is finely ground to the intended cam profile.

Upon completion of this fine grinding operation, there is read out one block X−D3F3 of the control data being memorized at a memory address *m*32. In accordance with the data X-D3F3, the wheel head 2 is retracted by the total grinding feed amount, which is the sum of the coarse and fine grinding feed amounts, at the rapid feed rate, and is thus returned to the transient original position. Thereafter, there is further read out one block END of the control data memorized at an address *m*33, and the execution of the grinding cycle ends upon resetting the run flag circuit 49. It is herein to be understood that, for the purpose of grinding a second cam of the workpiece W, the traverse table 25 is indexed in a well-known manner and the grinding cycle of the wheel head 2 is controlled in accordance with the same control data shown in TABLE 3.

Wheel Truing Cycle

The repetition of such a grinding cycle results in a deterioration of the metal removing ability of the grinding wheel 3 and therefore, the same is trued with the truing wheel 38 as follows: When the start push button switch PB4 is closed, the traverse table 25 is then moved by the cylinder device 35 to a truing ready position toward the left, as viewed in FIG. 1, and the truing wheel 38 is positioned slightly left of the grinding wheel 3. When the truing condition is satisfied as a result of indexing the traverse table 25 to the truing ready position, the start signal generating circuit 40 generates the start signal START4 to the run flag circuit 49. As the RUN signal is output, the shift register 44 generates the timing pulses CL1–CL5. The program counter 61 is set to an address number *m*40 based upon the start signal START4, and one block X−F3AS of the control data being memorized at an address *m*40, as shown in TABLE 4, is read out to the register 63 when the same receives the second timing pulse CL2. In accordance with the data X−F3AS, the wheel head 2 is retracted to the absolute original position where the original position detector 8 generates the positioning signal ASFIN. It is to be noted that, since the original position detector 8 is disposed immediately under the rotational axis of the grinding wheel 3, the grinding wheel 3 can be returned precisely to the absolute original position even if the wheel head 2 has suffered from thermal deformation in the previous grinding cycles.

The next one block X+D5F3 of the control data memorized at an address *m*41 is read out in the next one cycle, and in response to the control data D5, the first selector 75 selects the memory circuit 108. The memorized content of the memory circuit 108 is then preset to the subtraction counter 98 when the same receives the fourth timing pulse CL4, and the wheel head 2 is advanced to the transient original position at the rapid feed rate. In the subsequent one cycle, one block X+D3F3 of the control data memorized at address *m*42 is read out, and the wheel head 2 is advanced by the total grinding feed amount at the rapid feed rate. In the further subsequent one cycle, one block YD1PS of the control data being memorized at a memory address *m*43 is read out and, through the decoder 64, is applied to the AND gate 110, which, when receiving the fourth timing pulse CL4, then sets the memorized value of the memory circuit 108 to the value in up-down counter 99.

Furthermore, one block X+D4F3 is read out at the following one cycle, and the feed pulses F·OSC are generated from the pulse generator 90 at a frequency meeting the rapid feed rate. The feed pulses F·OSC are supplied to the drive circuit 92 through the gate circuit 91. Advance feed pulses +FP are generated by gate circuit 91 upon receipt of "+" pulses. These advance feed pulses +FP are applied to drive circuit 92 so as to rotate the servomotor 7 in the positive going direction, so that the wheel head 2 is further advanced by a truing infeed amount set by the digital switch 74. In this manner, the wheel head 2 is further advanced by the truing infeed amount beyond the advanced position in the grinding operation and is positioned at a truing position. Consequently, the grinding wheel 3 is infed by the truing infeed amount against the truing wheel 38. In this event, because the flip-flop 105 has been set upon receipt of the start signal START4, the advance feed pulses +FP are also supplied to the up terminal UP of the up-down counter 99, and the truing infeed amount is added to the content of the counter 99. One block YD1PM of the control data being memorized at a memory address *m*45 is read out in the following one cycle and as a result, the renewed content of the up-down counter 99 is fixedly memorized in the memory circuit 108. As there is finally read out one block END of the control data being memorized at a memory address *m*46, the decoder 64 outputs the signal END. In response to the signal END, the truer drive motor 39 is energized to rotate the truing wheel 38 and the traverse table 25 is moved by the cylinder device 35 toward the right, as viewed in FIG. 1, whereby the grinding wheel 3 is trued with the truing wheel 38 by the truing infeed amount.

Returning Cycle to Transient Original Position

After the wheel truing cycle, the foregoing returning cycle to the absolute original position is executed to return the wheel head 2 thereto, and in order to ready grinding operations. The wheel head 2 is then advanced to the transient original position in the following manner.

With the closing of the push button switch PB5, the start signal START5 is generated from the start signal generator 40, thereby effecting the generation of the RUN signal. The program counter 61 is set to an address number *m*50 and when the second timing pulse CL2 appears, there is read from program memory 60 one block X+D5F3 which is memorized at a memory address *m*50, as shown in TABLE 5. The wheel head 2 is advanced by the memorized value in the memory circuit 108 at the rapid feed rate and is positioned at a new transient original position. It is to be understood that, since the memorized value in the memory circuit 108 has been incremented by the truing infeed amount in the aforementioned wheel truing cycle, the grinding wheel 2 is additionally advanced by the truing infeed amount over the amount advanced before the wheel truing operation. This compensates for a reduced grinding wheel radius which was caused by the truing. Accordingly, the front end of the grinding wheel 3 reaches virtually the same advanced position it reached before the truing operation. The next one block END of the control data being memorized at a memory address *m*51 is then read out, and the execution of this returning cycle to the transient original position is completed.

Following this, the foregoing grinding operation is repeated to grind the workpiece W. When thermal deformation of the wheel head 2 in due course causes deterioration in the finish accuracy of the workpieces, there is timely executed the returning cycle to the absolute original position and the returning cycle to the transient original position, whereby the advanced position of the grinding wheel 3 may be corrected.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine comprising:

a bed, a wheel head slidably mounted upon said bed and adapted to rotatably carry a grinding wheel, work support means for rotatably supporting a workpiece, truing means for truing said grinding wheel, feed means for feeding said wheel head toward and away from said truing means, original position detecting means for detecting an absolute original position of said wheel head, distance designation means for designating a distance which is necessary for said wheel head to move from said absolute original position toward said truing means so as to infeed said grinding wheel by a predetermined truing infeed amount against said truing means, and feed control means responsive to a truing instruction for controlling said feed means to feed said wheel to said absolute original position determined by said original position detecting means and then to feed said wheel head by said distance designated by said distance designation means from said absolute original position toward said truing means.

2. A grinding machine as claimed in claim 1, further comprising:

means for selectively opposing said work support means and said truing means with said wheel head, said feed means being operable to feed said wheel head toward and away from said work support means when the same is opposed to said wheel head.

3. A grinding machine as claimed in claim 2, wherein said absolute original position detecting means comprises:

a dog member provided upon one end of said wheel head and said bed, and a sensing device provided upon the other end of said wheel head and said bed, said sensing device in an abuttable relation with said dog member and adapted to output a positioning signal when actuated by said dog member.

4. A grinding machine as claimed in claim 3, wherein said other end of said dog member and said sensing device mounted upon said wheel head is disposed immediately under a rotational axis of said grinding wheel.

5. A grinding machine as claimed in claim 2, wherein said distance designation means comprises:

memory means for memorizing a feed distance between said absolute original position and a transient original position, said transient original position being defined as the position from which said wheel head is moved toward said work support means in a grinding operation, a first setting switch for setting a total grinding feed amount through which said wheel head is moved from said transient original position to an advanced position in said grinding operation so as to grind said workpiece to a predetermined size, and a second setting switch for setting said predetermined truing infeed amount.

6. A grinding machine as claimed in claim 5, wherein said feed control means comprises;

a program memory for memorizing first, second, third and fourth blocks of control data programmed to control feed movement of said wheel head in a truing operation, timing pulse generating means for generating a predetermined number of timing pulses each time when receiving said truing instruction and a signal indicating the completion of any feed control operation executed in accordance with said any one of said first, second, third and fourth blocks of said control data, data read-out means for selectively reading out from said program memory said first, second, third and fourth blocks of said control data in a predetermined order each time a specified pulse of said predetermined number of said timing pulses is supplied, and drive control means responsive to another specified pulse of said predetermined number of said timing pulses for controlling said feed means to retract said wheel head to said absolute original position in accordance with said first block of said control data and then to advance said wheel head by said feed distance, said total grinding feed amount and said predetermined truing infeed amount being memorized and set respectively in said memory means and in said first and second setting switches, in accordance with said second, third and fourth blocks of said control data.

7. A grinding machine as claimed in claim 6, wherein said feed control means further comprises.

a plurality of feed rate setting switches for setting various feed rates, and wherein said drive control means includes:

a feed pulse generator for generating feed pulses at a designated frequency, a presettable subtraction counter for subtracting one from a preset value each time one of said feed pulses is supplied thereto, so as to generate said signal indicating the completion of any said feed control operation, a first selector for selectively connecting said memory means and said first and second amount setting switches with said subtraction counter in response to feed amount data from said data read-out means so as to selectively preset said feed distance, said total grinding feed amount and said predetermined truing infeed amount to said subtraction counter.

a second selector for selectively connecting said plurality of said feed rate setting switches with said feed pulse generator in response to feed rate data from said data read-out means so as to cause said feed pulse generator to generate said feed pulses at a frequency corresponding to said feed rate data, and a gate circuit responsive to direction designation signals from said data read-out means for supplying said feed pulses to said drive means as advance or retraction feed pulses.

8. A grinding machine as claimed in claim 7, wherein said means for selectively opposing said work support means and said truing means to said wheel head comprises:

a traverse table slidably mounted on said bed for movement in a transverse direction with respect to the movement of said wheel head, said work support means and said truing means being mounted on said traverse table.

9. A grinding machine as claimed in claim 8 wherein: said grinding wheel is made of cubic boron nitride.

* * * * *